United States Patent [19]

Guthrie et al.

[11] 4,326,706

[45] Apr. 27, 1982

[54] JOGGING GLOVE

[75] Inventors: Phillip K. Guthrie, Menard; Richard W. Pillow, Decatur, both of Ill.

[73] Assignee: Fitness Concepts, Inc., Decatur, Ill.

[21] Appl. No.: 55,530

[22] Filed: Jul. 9, 1979

[51] Int. Cl.[3] ..... A63B 21/12

[52] U.S. Cl. ..... 272/119; 2/160

[58] Field of Search ..... 272/93, 67, 119; 2/160, 2/167

[56] References Cited

U.S. PATENT DOCUMENTS

| | | | |
|---|---|---|---|
| 2,187,987 | 1/1940 | Sherrick | 2/160 |
| 3,369,258 | 2/1968 | Smith | 272/93 X |
| 4,034,979 | 7/1977 | Wester | 273/54 B |

FOREIGN PATENT DOCUMENTS

| | | | |
|---|---|---|---|
| 8925 | of 1904 | United Kingdom | 2/160 |

*Primary Examiner*—Richard C. Pinkham
*Assistant Examiner*—William R. Browne
*Attorney, Agent, or Firm*—Rogers, Eilers & Howell

[57] ABSTRACT

A glove for joggers having a weight fixed to its back side in the metacarpal area and another weight removably applied to the palm side of the glove at the outer metacarpal area. The first weight is surrounded by a plastic flanged cover and it projects through an opening in the back of the glove, the flange being stitched to the glove around the opening. The palm side weight is non-circular in a non-circular pocket from which it can be removed and which disposes it over the outer metacarpal area.

3 Claims, 5 Drawing Figures

JOGGING GLOVE

BACKGROUND AND OBJECTS

In the past athletic gloves for different sports such as bowling, golf and the like have been offered, but none, to applicants' knowledge, has been particularly designed for use of joggers.

The present invention provides a jogging glove that can have two weights on it, one on the back of the hand and one at the palm side of the hand. Both of the weights are disposed to permit maximum flexing of the wrist and fingers into the positions they normally assume in jogging. The back of the hand weight may be permanently attached and the inside or palm weight readily changeable. By this means, a certain minimum weight may be provided on the glove with the opportunity to change the total amount of weight without difficulty.

Another object of the present invention is to provide a weight assembly or unit that can be permanently attached to a glove with a minimum of problems. To this end the weight unit comprises a weight member encompassed and bound in a flanged cover, the flange being penetratable by stitching needles so that the weight unit can be attached to the glove by the flange with the main part of the unit projecting through a hole in the glove. By this arrangement the weight itself is covered, giving a neat appearance. Yet the weight does not misshape the glove, when it is mounted thereon, or require a bulging pocket attached to the outside of the glove. The weight is located in the middle of the metalcarpal area, so that it does not interfere with the normal flexing of the wearer's wrist.

On the palm weight, which represents a removable type of weight, it is an object to have a non-circular pocket with a snap fastener or the like into which a weight can be inserted. It is also an object to have the weight non-circular so that it will not twist when in position in the pocket, but also to have rounded corners on it so that it can be inserted and removed more readily. In the preferred form, it is elongated in shape with rounded ends. It is an object to have this weight adjacent the knuckle joints so that it has minimal interference with the finger positions of the jogger. Other objects and advantages will appear from the description to follow.

While prior art such as Shirey U.S. Pat. No. 3,203,006 shows a weight in a pocket on the palm of the glove, and the Wester U.S. Pat. No. 4,034,979 shows a weight in a pocket on the back of the glove, in neither of these is the weight formed into a unit with the plastic cover so that it can be stitched to the glove by stitching around the marginal flange of the plastic to which the weight is permanently adhered. Furthermore, there is no provision in these patents or others known to the applicants wherein the weight is projected through an opening in the glove.

Prior art such as Sherrick Pat. No. 2,187,987 and the Campbell U.S. Pat. No. 3,124,806 shows pockets with snap fasteners. However, these pockets and weights are not arranged across the palm of the hand in the manner shown in the present disclosure. Wester U.S. Pat. No. 4,034,979 shows two weights, neither removable, and not disposed to permit flexing of the wrist and fingers as required by a jogger.

The sectional views 3–5 are somewhat enlarged.

DESCRIPTION OF THE PREFERRED EMBODIMENT

The glove of the present invention includes a hand covering portion 10 that may be of leather, artificial leather, cloth or the like. It may or may not have open finger ends. In the illustration it is shown as having open finger ends 11, 12, 13, 14 and open thumb end 15. Said finger portions hold the glove out from the wrist. It is also shown as having an elastic wrist gathering portion 16. It is expected that these gloves will be sold in pairs, and that a right-hand glove will be a counterpart of the one illustrated.

On the palm side the glove is provided with a weight and on the back side it is provided with another weight. These two weights are fastened in differently, and illustrate two methods of providing for the combinations of weights.

Figure 2:
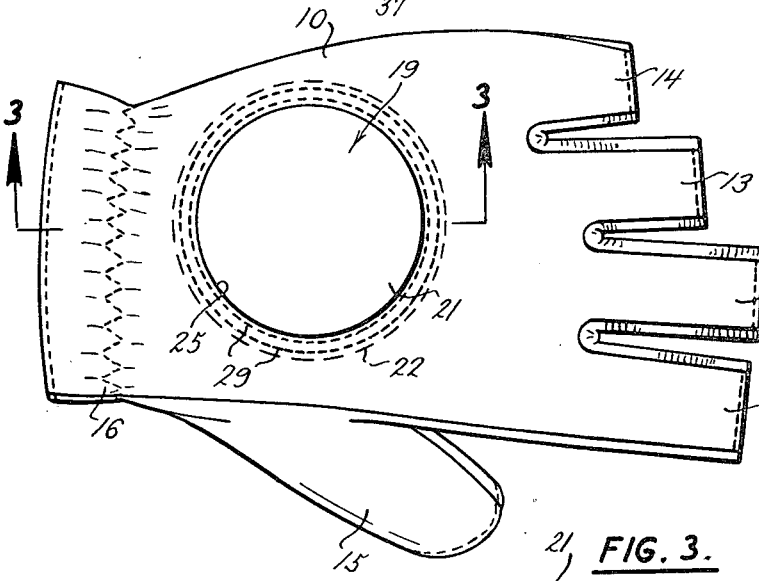
FIG. 2 is a view of the back side of the glove with the weight in place.
Figure 3:
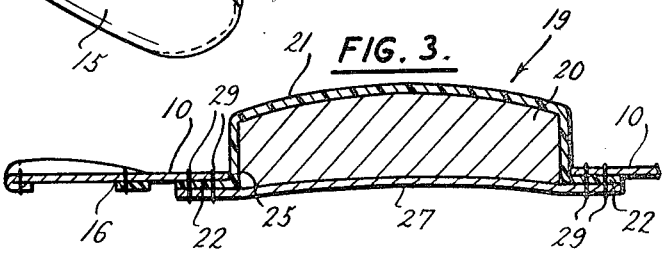
FIG. 3 is a section on the line 3—3 of FIG. 2.

The preferred assembly is that shown in FIGS. 2 and 3. In them there is a weight subassembly 19 which consists of a weight 20 about which is molded a plastic cup 21 having a flange 22 about it. In the present example, this weight is shown as circular, and somewhat disc-like or flattened, with its bottom slightly concave. The flange 22 surrounds the weight at its bottom edge and projects radially therefrom. The plastic may be any of the moldable plastics such as material that can be injection molded about and bonded to the weight 20 so that with the weight it acts as a unit. The plastic is one that can be penetrated by sewing machine stitching needles.

The body portion 10 of the glove has a circular opening 25 in the back thereof through which the circular projecting portion of the weight unit 19 can project, exposing the plastic cover, with flange 22 resting against the inside of the glove 10 around the opening. An inner liner 27, of leather or other such material, and also circular, preferably is fitted underneath the weight 20 and the flange 22 for comfort. Then stitching 29 is applied all around the weight subassembly 19 and through the liner 27 to hold the weight in place. This prevents the weight from stretching or misshaping the glove portion 10 and coming loose therefrom.

Figure 1:
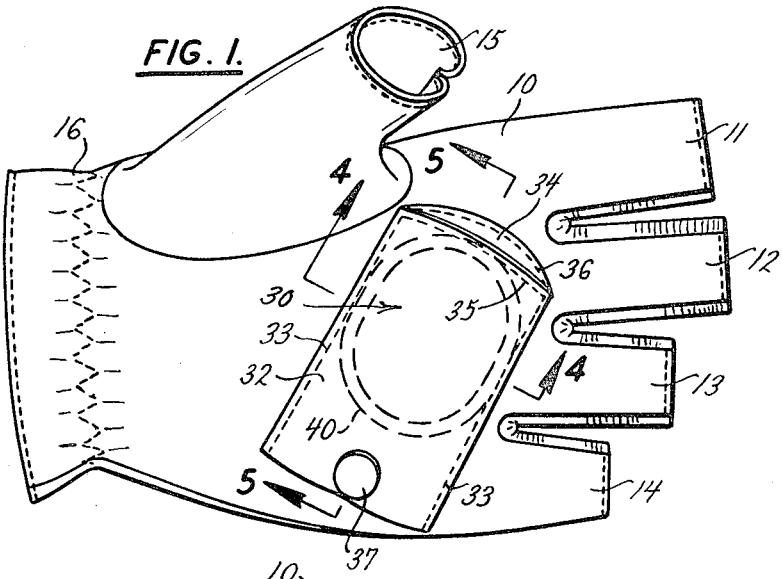
FIG. 1 is a view of the palm side of the glove, the weight being in a pocket and shown in dashed lines.
Figure 4:
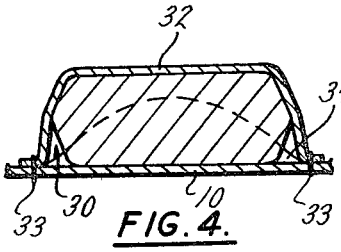
FIG. 4 is a section on the line 4—4 of FIG. 1.
Figure 5:
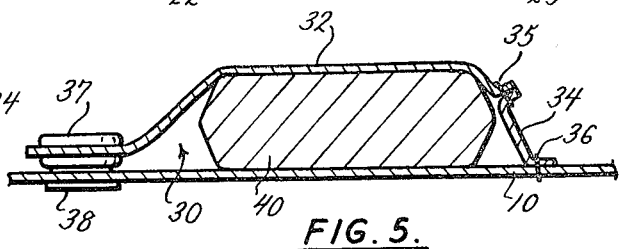
FIG. 5 is a view on the line 5—5 of FIG. 1.

The inner side weight is preferably secured to the glove in a way permitting it to be removed. See FIGS. 1, 4 and 5. In these figures, a pocket 30 is formed by a piece of material from which the glove is made, or any other appropriate piece of cloth-like material 32, stitched along its lateral edges at 33 to the main glove material 10. An end piece 34 is stitched at 35 to the end of the pocket material 32, and at 36 to the glove material. This insert 34 aids in giving volume to the space under the main pocket material 32.

A snap fastener or the like is shown at 37 on the pocket 32. It cooperates with a button 38 on the glove material.

The pocket 30 is opened and filled by releasing the snap fastener 37 and inserting the weight 40 therein. The weight is here shown as being at least slightly elongated with rounded ends so that it does not twist in the pocket, but can be easily inserted and removed.

The pocket 30 extends at a small angle to the transverse dimension of the hand, and ends adjacent the inside of the metacarpal knuckle joints of the two middle fingers. By this disposition the weight may be easily inserted with the fingers slightly bent. This loosens the fabric of the pocket, and places the entry to it at the low point of the heel of the hand. It also places the weight in the place where there is the least interference with bending of the jogger's fingers.

It is expected that different sized weights will be used even with the weight 20. To obtain a different size of the weight 20, however, requires a different glove made with a different weight. The advantage of the removable weight arrangement such as the arrangement for the weight 40 is that weights of different magnitude may be inserted and used with the same glove.

The weights may be of some appropriate value. Normally the total weight per hand is from one-half pound to two pounds, divided between the two weights.

Attention is called to co-pending application Ser. No. 956,285 filed November 30, 1978, now abandoned, wherein co-inventor Guthrie is a co-inventor, and which illustrates some arrangements to which the present disclosure discloses improvements.

Various changes and modifications may be made within this invention as will be readily apparent to those skilled in the art. Such changes and modifications are within the scope and teaching of this invention as defined by the claims appended hereto.

What is claimed is:

1. A pair of athletic gloves for jogging, one glove being shaped and constructed for wearing on the left hand and the other glove being shaped and constructed for wearing on the right hand, each glove having a main glove portion, a portion engageable around the palm portion of the hand, and finger portions to hold the glove out from the wrist; and a first weight unit therefor having a somewhat flattened weight, and means attaching the weight to the back of the glove portion to hold the weight unit on the glove, a second weight for the front or palm portion of the glove, means to attach the second weight transversely to the palm portion of the glove adjacent the outer metacarpal knuckle joints, extending at a slight angle to the metacarpal area of the second and third fingers, the second weight being disposed to extend essentially along the said knuckle area of the plam portion of the glove inwardly of the finger portions, and essentially outwardly displaced away from the thumb area, to permit flexing of the fingers when the weight is in place into the positions they normally assume in jogging.

2. The athletic glove of claim 1 wherein at least one of the weights of each glove is readily removable from the glove to enable the total amount of weight to be varied.

3. The athletic glove of claim 1 wherein there is a pocket on the palm side of each glove to receive the second weight, the weight in the pocket being somewhat elongated, the pocket extending in the general direction of the knuckle joints, the pocket having an opening to enable the second weight to be removed and replaced, and means to secure the second weight in the pocket.

* * * * *